US005810266A

United States Patent [19]

Nyssen et al.

[11] Patent Number: 5,810,266

[45] Date of Patent: Sep. 22, 1998

[54] PROCESS AND AN APPARATUS FOR PRODUCING FINELY DIVIDED SOLIDS DISPERSIONS

[75] Inventors: Peter Roger Nyssen, Dormagen; Klaus-Wilfried Wanken, Leverkusen; Bernd Klinksiek, Gladbach, all of Germany

[73] Assignee: Bayer Aktiengesellschaft, Leverkusen, Germany

[21] Appl. No.: 710,991

[22] Filed: Sep. 25, 1996

[30] Foreign Application Priority Data

Oct. 2, 1995 [DE] Germany ..... 195 36 845.2

[51] Int. Cl.[6] ..... B02C 19/06

[52] U.S. Cl. ..... 241/5; 241/16; 241/21; 241/39; 241/152.1

[58] Field of Search ..... 241/1, 5, 16, 21, 241/39, 152.1, 171

[56] References Cited

U.S. PATENT DOCUMENTS

| | | | |
|---|---|---|---|
| 4,081,863 | 3/1978 | Rees | 336/176 |
| 4,186,772 | 2/1980 | Handleman | 241/5 X |
| 4,592,302 | 6/1986 | Motoyama et al. | 241/39 X |
| 4,784,333 | 11/1988 | Hikake et al. | 241/5 |
| 4,811,907 | 3/1989 | Niemi et al. | 241/5 |
| 4,860,959 | 8/1989 | Handleman | 241/5 X |
| 4,917,309 | 4/1990 | Zander et al. | 241/16 X |
| 5,111,998 | 5/1992 | Kanda et al. | 241/39 X |
| 5,129,586 | 7/1992 | Artemjev et al. | 241/5 |
| 5,421,524 | 6/1995 | Haddow | 241/5 |
| 5,577,670 | 11/1996 | Omata et al. | 241/5 |
| 5,628,464 | 5/1997 | Smith et al. | 241/5 |

FOREIGN PATENT DOCUMENTS

| | | | |
|---|---|---|---|
| 2633288 | 2/1977 | Germany . | |
| 2063695 | 6/1981 | United Kingdom . | |
| 87/06854 | 11/1987 | WIPO | 241/5 |

*Primary Examiner*—John M. Husar

*Attorney, Agent, or Firm*—Sprung Kramer Schaefer & Briscoe

[57] ABSTRACT

This invention relates to a process for producing finely divided dispersions of solids having an average particle size of 0.01 to 20 $\mu$m by the comminution of coarse particulate dispersions in a hole- or slit-type nozzle 4 having a specific bore length to diameter ratio at a pressure difference greater than 5 bar between the nozzle inlet and the nozzle outlet. The invention also relates to an apparatus for producing the finely divided dispersion.

11 Claims, 4 Drawing Sheets

PROCESS AND AN APPARATUS FOR PRODUCING FINELY DIVIDED SOLIDS DISPERSIONS

BACKGROUND OF THE INVENTION

This invention relates to a process for producing finely divided dispersions of solids having an average particle size of 0.01 to 20 μm by the comminution of coarse particulate dispersions (particle size greater than 20 μm) in a hole- or slit-type nozzle having a specific bore length to diameter ratio at a pressure difference greater than 5 bar between the nozzle inlet and the nozzle outlet. The invention also relates to an apparatus for producing the finely divided dispersions.

A series of processes has become known for the comminution of solids which are based on the mechanical treatment of the solids, particularly as a solids dispersion. Thus roller grinding mills are used for the fine grinding of cement, lime or gypsum. Rotor/stator grinding systems, for example, utilise the forces in the shear gap between the rotor and the stator for comminution. So-called cylinder mills are used for pigment formation or for the de-agglomeration of agglomerates of finely divided solids, for example.

Ball mills, or agitator mills in general, are used for the wet comminution of solids having a particle size of less than 100 μm, which is nearest to the process according to the invention in this area of application. These utilise the shear forces of grinding bodies made of glass, ceramic, metal or sand, and result in comminution down to an average particle size (number average) of typically 1 μm. The area of application of agitator mills is the fine grinding of sensitive, coarse particulate solids. Examples which should be mentioned include the wet comminution and forming of disperse dyes in aqueous media and the de-agglomeration of organic and inorganic pigments in aqueous or organic media (in this connection, see also Prof. Dr. J. Schwedes, lecture No. 7 at the Technical Conference of the Gesellschaft für Verfahrenstechnik Chemieanlagen [*Society for Chemical Installation Process Technology*] held in Cologne in 1993).

When processing solids in an agitator mill, however, the following considerable disadvantages have to be accepted. Due to the use of grinding bodies, the product may contain abraded material from the grinding bodies at a content of the order of up to 1% by weight. The grinding effect disappears when the viscosity of the starting material dispersion is too low, e.g. with dilute aqueous dispersions, as it does when using highly viscous dispersions. A relatively large amount of thermal energy is released in agitator mills due to friction, and has a negative effect on heat-sensitive material to be ground as regards the quality of the product. In addition, agitator mills have a lower comminution efficiency. The latter term denotes the volumetric energy density for a defined comminution output. The operation and construction of agitator mills is technically complicated, since an enhanced extent of measurement and control technology is necessary for controlling the mills. Moreover, the maintenance, servicing and upkeep of agitator mills are costly. The aforementioned unwanted release of heat results in a high cost of cooling the material being ground.

The object of the present invention is to provide a process which enables solids to be comminuted without having to accept the disadvantages of known mechanical mills described above, and which provides solids having a particle size from 0.01 to 20 μm. These data, and all further data on particle size, relate to the number average diameter in each case.

SUMMARY OF THE INVENTION

This object is achieved according to the invention by a process for producing finely divided dispersions of solids having an average particle size of 0.01 to 20 μm from a coarse particulate preliminary dispersion, characterised in that the preliminary dispersion, consisting of 1 to 60% by volume of solids and at least 40 to 99% by volume of a non-solvent for the solid, which is preferably a solid having an average particle size <1 mm, and optionally additionally consisting of 1 to 200 parts by weight of dispersing aids and/or surface-active compounds, with respect to 100 parts by weight of solid, is conducted in at least one pass through at least one nozzle which has at least one bore or at least one slit aperture having a bore diameter or an aperture width of 0.05 to 1 mm and having a length to diameter ratio of the bore or a depth to aperture width ratio of the slit aperture of 1:1 to 10:1, and wherein a pressure difference of at least 5, preferably at least 10 bar, exists between the nozzle inlet and the nozzle outlet. In the preferred process, the average particle size of the solid particles of the initial dispersion before comminution is from 0.1 μm to 1 mm. In particular, the non-solvent for forming the dispersion should dissolve the solid in an amount of less than 1% by weight at most, preferably <0.1% by weight. In principle, agglomerates of solid particles having an average agglomerate diameter of 1 to 100 μm can be subjected to comminution by the process according to the invention, as can aggregates having an average particle size of 0.1 to 1 μm. After carrying out the process, agglomerates have an average particle size of <10 μm, for example, and aggregates have an average particle size of <0.5 μm, for example.

In particular, organic and inorganic dyes, and also pigments, carbon blacks, earths, active ingredients for pharmaceuticals and for plant protection applications, and other solids, can be ground by the process according to the invention. This listing is to be understood as being merely by way of example.

The viscosity of the initial dispersion can be selected within wide limits. Dilute dispersions in water can be processed just as readily as dispersions of higher viscosity. The dispersions should be flowable or capable of being pumped.

The present invention also relates to an apparatus for producing finely divided dispersions having an average particle size of 0.01 to 20 μm, consisting at least of a high pressure space and a low pressure space for receiving the dispersions and a comminution nozzle disposed therebetween as a hole- or slit aperture-type nozzle, characterised in that the bore diameter or the aperture width of the nozzle is 0.05 to 1 mm and the length to diameter ratio of the bore or the depth to aperture width ratio of the slit aperture of the nozzle is from 1:1 to 10:1. Nozzles are preferred which have at least two bores or slit apertures with their respective outlets opposite. Nozzles are particularly preferred in which the spacing between the outlets of at least two opposite bores or apertures is 2 to 50 times the bore diameter or of the aperture width. In one preferred embodiment, the bore diameter or the aperture width of one aperture of the nozzle is from 0.1 to 0.5 mm. Ceramic materials, preferably oxide and graphitic ceramic materials or optionally materials coated with the said ceramics, are used in particular as the material for the production of the comminution nozzle. Insofar as other preferred forms of construction are not expressly described, they are to be taken from the claims.

The complicated measurement and control technology of agitator mills is in contrast to the relatively simple operation of a comminution nozzle. As a simple pipeline component, the apparatus for comminution according to the invention can be designed and operated in a manner which is less problematical and less costly compared with conventional mills. Separate cooling is dispensed with, and the comminution efficiency is very much higher, since the utilisation of energy is greater in the apparatus according to the invention. Dispensing with grinding bodies eliminates contamination of the product by abraded material from the grinding bodies. Suitable preferred fluids (non-solvents) for forming the dispersions used in the process according to the invention are selected according to the type of solid to be comminuted, and may include, for example:

for disperse dyes, generally water for organic or inorganic pigments, generally water or an organic non-solvent (e.g. a polyol).

The comminution nozzle is preferably formed from hard, resistant, optionally inert materials such as oxide, graphitic and other ceramics, and is also preferably formed based on conventional materials, such as metals, which are provided with coatings of ceramic or with similar hard coatings.

BRIEF DESCRIPTION OF THE DRAWINGS

The invention is described in more detail below by way of examples, and with reference to the Figures, where.

Figure 1:
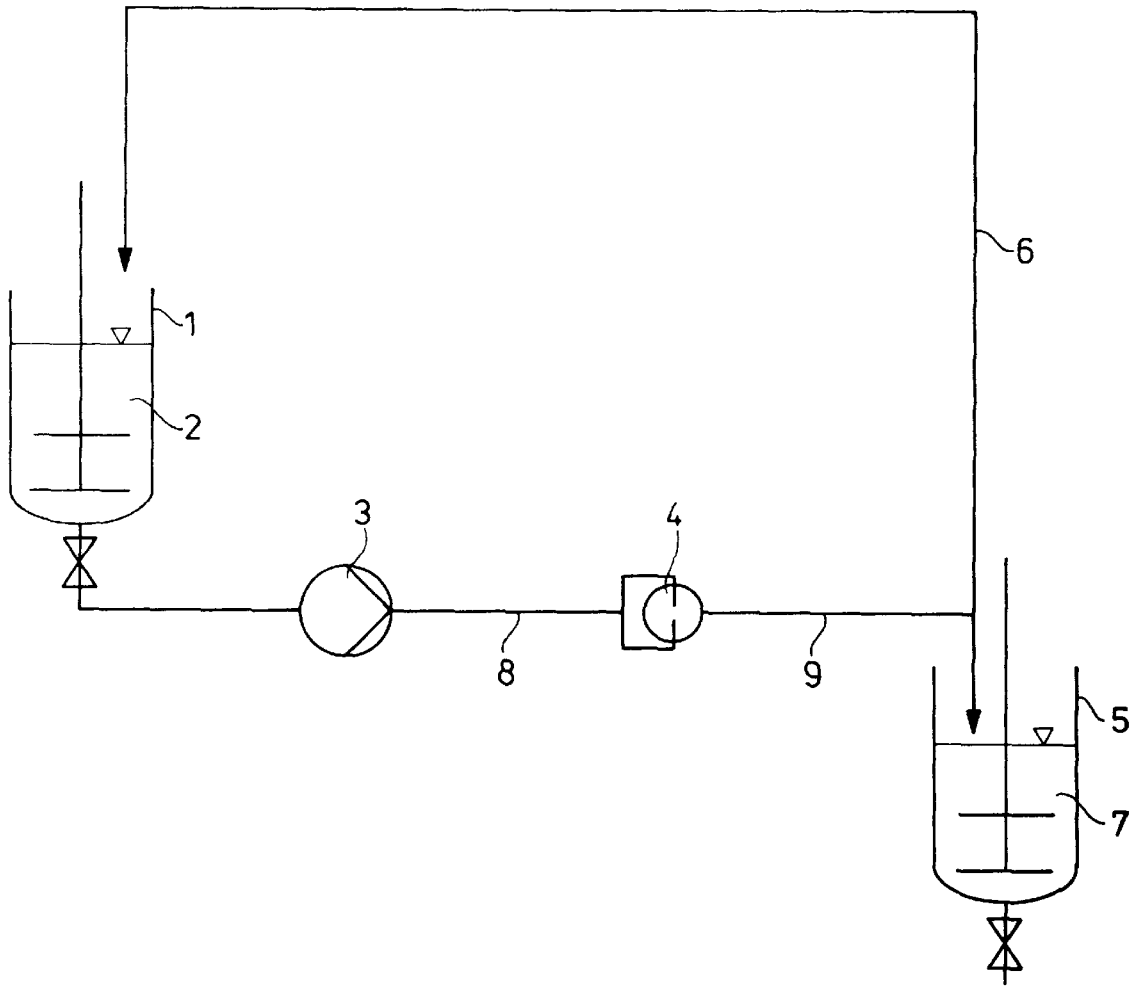
FIG. 1 is a diagram of an arrangement for carrying out the process according to the invention.

In the simplest case, the dispersion 2 is fed from a supply vessel 1 fitted with a stirrer, via a pump 3 and a high pressure line 8, to the high pressure side of a nozzle 4. The dispersion passes through the nozzle 4 and is fed via the low pressure line 9 either to the container 5 for the finer product dispersions 7 or through a return line 6 to the starting vessel 1 for a renewed pass.

Figure 2:
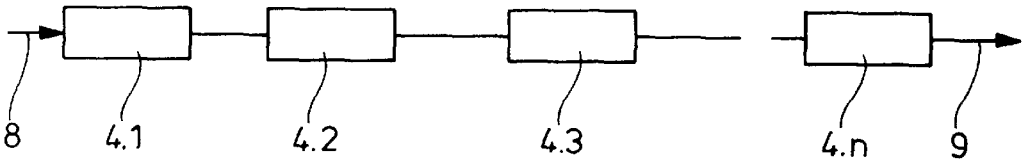
FIG. 2 is a scheme for the replacement of one nozzle in FIG. 1 by an n-stage nozzle arrangement.

As shown in FIG. 2, a plurality of comminution nozzles 4.1, 4.2 to 4.n may also be connected directly in series in order to improve the comminution effect.

EXAMPLE 1

The disperse dye C.I. Disperse Red 343 (red monoazo dye) and the lignin sulphonate dispersing agent UFOXANE RG manufactured by Borregard were beaten together to form a preliminary dispersion in water in a ratio of 10 parts to 8 parts and at a solids concentration of 25 or 45% by weight; 0.5% by weight, with respect to the dye, of the anti-foaming agent Surfynol 104 E manufactured by Air Products was added at the same time.

Figure 3:
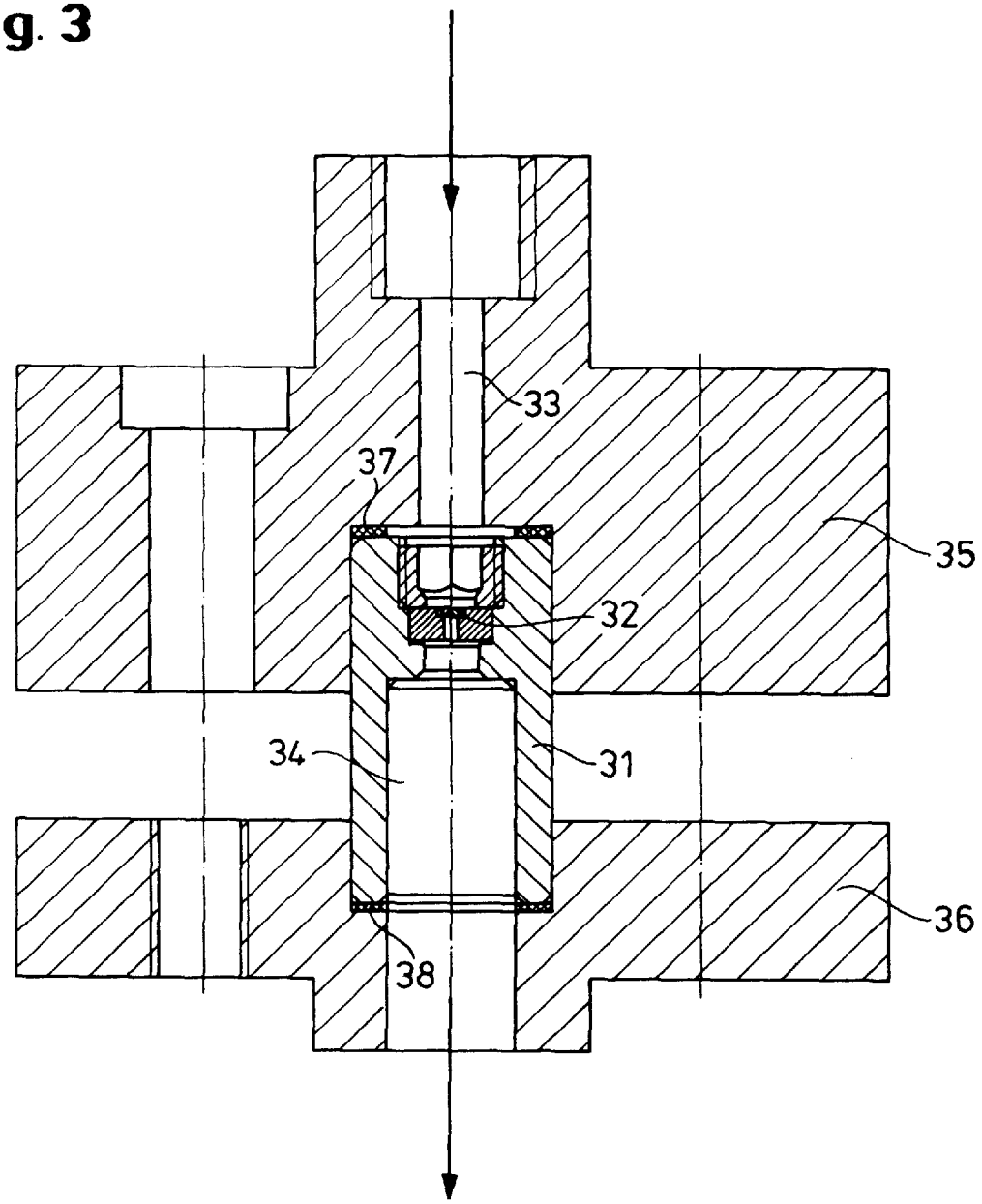
FIG. 3 is a sectional view of a comminution nozzle for carrying out the process according to the invention.

The dispersion was comminuted and formed in one or more passes at different pressures by means of a moderated diaphragm-type pump 3 as shown in FIG. 1, using a single nozzle 32 made of zirconia and with a bore diameter of 0.2 mm corresponding to FIG. 3. The nozzle body 31 was seated clamped between the flanges 35 and 36 and was sealed by seals 37, 38 to prevent the emergence of the dispersion from the high pressure space 33 or low pressure space 34.

The particle size $d_{10}$, $d_{50}$, $d_{90}$ corresponding to the distribution curve is given, compared with that of the preliminary dispersion, for 25% by weight (Table 1a) and for 45% by weight (Table 1b).

TABLE 1A

Solids concentration 25% by weight

| Passes Pressure difference | Preliminary dispersion | Once 200 bar | 3 times 200 bar | 5 times 200 bar | 3 times 400 bar |
|---|---|---|---|---|---|
| $d_{10}$ (μm) | 0.22 | 0.2 | 0.19 | 0.19 | 0.19 |
| $d_{50}$ (μm) | 0.91 | 0.74 | 0.68 | 0.65 | 0.63 |
| $d_{90}$ (μm) | 8.70 | 6.0 | 5.39 | 5.04 | 4.7 |

TABLE 1b

Solids concentration 45% by weight

| Passes Pressure difference | Preliminary dispersion | Once 200 bar | 3 times 200 bar | 5 times 200 bar | 10 times 200 bar | 10 times 400 bar |
|---|---|---|---|---|---|---|
| $d_{10}$ (μm) | 0.21 | 0.19 | 0.19 | 0.19 | 0.23 | 0.22 |
| $d_{50}$ (μm) | 0.89 | 0.65 | 0.61 | 0.60 | 0.60 | 0.52 |
| $d_{90}$ (μm) | 7.74 | 4.67 | 4.27 | 4.26 | 3.56 | 2.65 |

EXAMPLE 2

Figure 4:
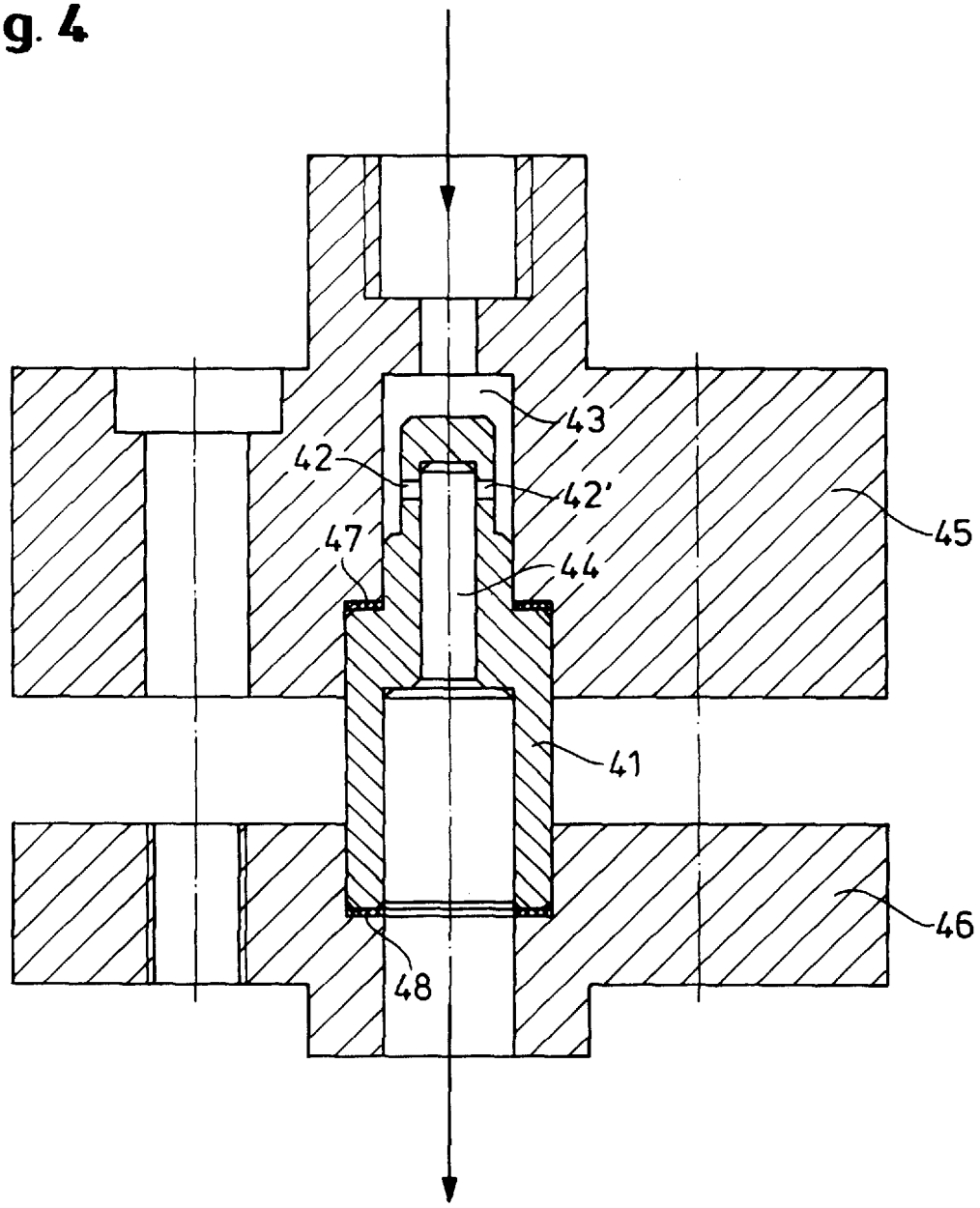
FIG. 4 is a section through a preferred construction of the comminution nozzles according to the invention, comprising opposite nozzle bores.

The same batches were used as in Example 1. However, the dispersion was comminuted via a nozzle having two opposite bores as shown in FIG. 4 (Example 2.4), comprising two bores 42, 42' of bore diameter 0.5 mm and a with spacing between the bore outlets of 6.5 mm, and was also comminuted corresponding to the apparatus shown in FIG. 5, with two bores of bore diameter 0.2 mm and spacings between the bore outlets of 18 and 10 mm (Examples 2.1, 2.2 and 2.3). The results (particle size) are given in Table 2 by comparison with the preliminary dispersion.

TABLE 2

2.1 Solids concentration 25%; 2 bores of 0.2 mm, spacing 18 mm

| Passes Pressure | Preliminary dispersion | Once 200 bar | 3 times 200 bar | 5 times 200 bar |
|---|---|---|---|---|
| $d_{10}$ (μm) | 0.22 | 0.20 | 0.19 | 0.19 |
| $d_{50}$ (μm) | 0.91 | 0.71 | 0.66 | 0.62 |
| $d_{90}$ (μm) | 8.70 | 5.67 | 5.09 | 4.78 |

2.2 Solids concentration 45%; 2 bores of 0.2 mm, spacing 18 mm

| Passes Pressure | Preliminary dispersion | Once 200 bar | 3 times 200 bar | 10 times 200 bar |
|---|---|---|---|---|
| $d_{10}$ (μm) | 0.21 | 0.19 | 0.19 | 0.19 |
| $d_{50}$ (μm) | 0.89 | 0.63 | 0.60 | 0.60 |
| $d_{90}$ (μm) | 7.74 | 4.61 | 4.10 | 3.42 |

As shown in FIG. 4, the nozzle 41 was clamped between the flanges 45, 46 and the seals 47, 48. The dispersion flowed from the high pressure space 43 via the bores 42 and 42' to the low pressure space 44.

Figure 5:
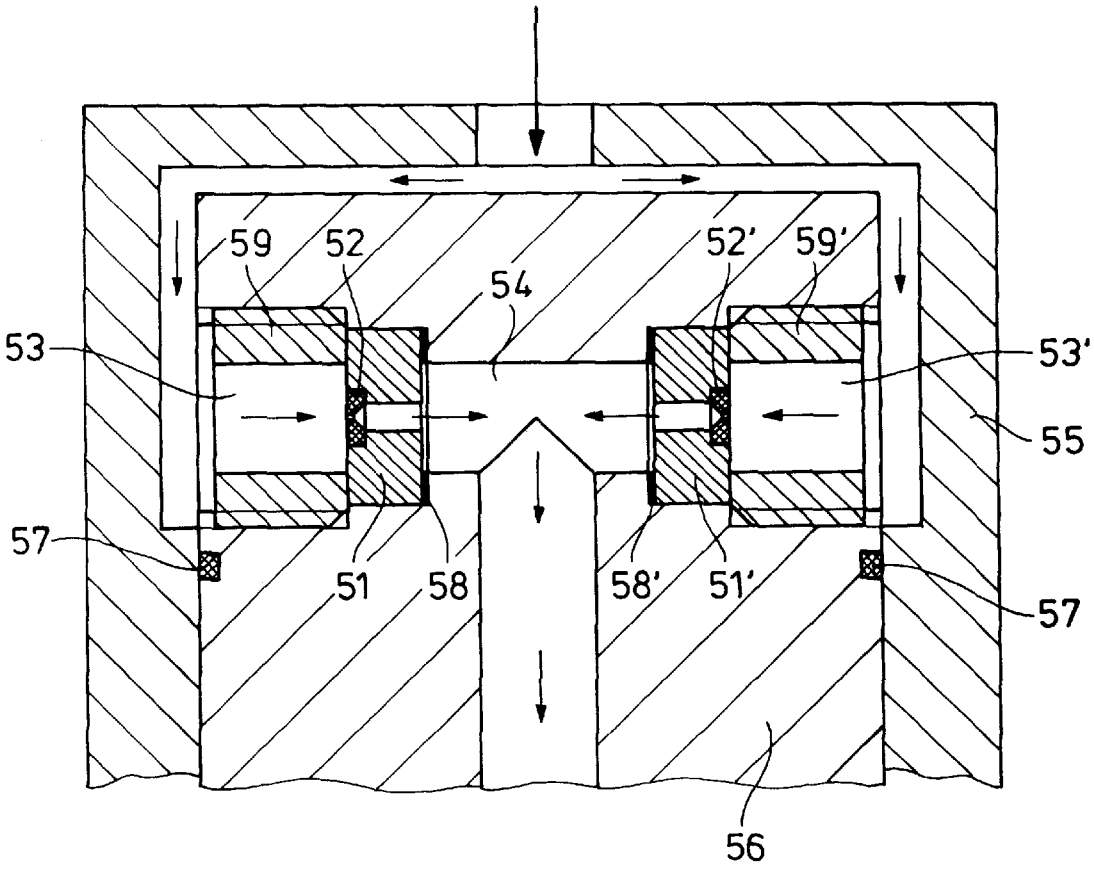
FIG. 5 is a section through a variant of the apparatus according to the invention, comprising two opposite single-bore nozzles.

FIG. 5 shows a variant with a removable top part 55 for the formation of the high pressure spaces 53 and 53', respectively, from which the dispersion is comminuted through separate nozzle bodies 51, 51' in the nozzles 52 and 52'. The high pressure side and the low pressure space 54 are sealed by seals 57 and 58, 58', respectively.

The nozzle bodies 52, 52' were fixed with screws 59 and 59'.

2.3 Solids concentration 45%; 2 bores of 0.2 mm, spacing 10 mm

| Passes Pressure | Preliminary dispersion | Once 200 bar | 10 times 200 bar |
|---|---|---|---|
| $d_{10}$ (μm) | 0.21 | 0.19 | 0.19 |
| $d_{50}$ (μm) | 0.89 | 0.63 | 0.59 |
| $d_{90}$ (μm) | 7.74 | 4.55 | 3.0 |

2.4 Solids concentration 45%; 2 bores of 0.5 mm, spacing 6.5 mm

| Passes Pressure | Preliminary dispersion | Once 200 bar | 3 times 200 bar | 5 times 200 bar |
|---|---|---|---|---|
| $d_{10}$ (μm) | 0.22 | 0.2 | 0.19 | 0.19 |
| $d_{50}$ (μm) | 0.91 | 0.68 | 0.65 | 0.61 |
| $d_{90}$ (μm) | 8.70 | 5.50 | 5.05 | 4.66 |

EXAMPLE 3

The disperse dye Disperse Yellow 5 GL and the lignin sulphate dispersing agent UFOXANE RG manufactured by Borregard were beaten together to form a preliminary dispersion in water in a ratio of 10 parts to 3 parts and at a solids concentration of 18 by weight; 0.5% by weight, with respect to the dye, of the anti-foaming agent Surfynol 104 E manufactured by Air Products was added at the same time.

The dispersion was comminuted and formed in one or more passes at different pressures by means of a moderated diaphragm-type pump 3 as shown in FIG. 1, using a dual nozzle made of zirconia and with a bore diameter of 0.5 mm corresponding to FIG. 4.

Table 3 shows the average particle size obtained ($d_{10}$, $d_{50}$, $d_{90}$ and $d_{100}$ value).

TABLE 3

| Passes Pressure | Preliminary dispersion | Once 100 bar | 3 times 100 bar | 5 times 100 bar | Once 190 bar | 5 times 190 bar |
|---|---|---|---|---|---|---|
| $d_{10}$ (μm) | 7.0 | 0.4 | 0.4 | 0.4 | 0.4 | 0.3 |
| $d_{50}$ (μm) | 22.2 | 1.0 | 0.8 | 0.7 | 0.7 | 0.6 |
| $d_{90}$ (μm) | 41.6 | 3.3 | 2.6 | 2.1 | 2.1 | 1.6 |
| $d_{100}$ (μm) | 75 | 8.0 | 8 | 4.0 | 4.0 | 3.1 |

EXAMPLE 4

A preliminary dispersion of an organic coloured pigment with a solids content of 13% by weight for the automobile lacquer field of application, which existed in the form of coarse agglomerates (see Table 4), was de-agglomerated 10 times into fine particles through a nozzle as shown in FIG. 4, with opposite bores of 0.5 mm and with a spacing of 6.5 mm between the nozzle outlets, at 200 bar by means of a diaphragm-type pump. The results are given in Table 4.

| Particle size | Preliminary dispersion | 10 passes pressure difference 200 bar |
|---|---|---|
| $d_{10}$ | 0.2 μm | 0.2 μm |
| $d_{50}$ | 0.63 μm | 0.38 μm |
| $d_{90}$ | 11.86 μm | 0.92 μm |

EXAMPLE 5

The plant protection medium Folicur (a herbicide) was ground to a particle size of 5–10 μm by air jet milling.

20 parts of the powder were then suspended, in a stirred vessel, in 78.5 parts of water in which 1.5 parts of the emulsifier Marlon A (manufactured by Marl-Hüls) were dissolved.

The suspension was subsequently dispersed down to an average particle size of 0.7 μm at 500 bar using a dispersing apparatus as shown in FIG. 5, which was equipped with 2 nozzles of 0.2 mm at a spacing of 18 mm.

The dispersion was stable and did not settle.

We claim:

1. A process for producing finely divided dispersions of solids having an average particle size of 0.01 to 20 μm from a coarse preliminary dispersion of 1 to 60% by volume of solids and at least 40 to 99% by volume of a non-solvent for the solid, having an average particle size <1 mm, said dispersion optionally including 1 to 100 parts by weight, with respect of the solids, of dispersing aids and/or surface-active compounds, which comprises passing said coarse preliminary dispersion in at least one pass through at least one apparatus (4) which apparatus comprises at least one nozzle (32) or at least one slit aperture having a bore diameter or an aperture width of 0.05 mm and having a length to diameter ratio of the bore or a depth to aperture width ratio of the slit aperture of 1:1 to 10:1, while maintaining a pressure difference of at least 5 bar between the nozzle inlet and the nozzle outlet.

2. A process according to claim 1, characterised in that the average particle size of the solid particles of the initial dispersion before comminution is from 0.1 μm to 1 mm.

3. A process according to claim 1, characterised in that dyes or pigments are used as the solids.

4. A process according to claim 1, characterised in that water is used as the non-solvent, and wherein the solid has a solubility of <1% by weight in the non-solvent.

5. A process according to claim 1, characterised in that initial dispersion is conducted in successive passes through two or more nozzles (4.1, 4.2) having an equal or decreasing bore diameter or an equal or decreasing aperture width of the nozzles.

6. A process according to claim 1, characterised in that the initial dispersion comprises solid agglomerates having an average diameter of 1 to 100 μm and/or solid aggregates having an average diameter of 0.1 to 1 μm.

7. A process according to claim 1, characterised in that after the last pass through the dispersing nozzle the dispersion is subjected to at least one additional grinding operation in a bead mill.

8. An apparatus for producing finely divided dispersions of solids having an average particle size of 0.01 to 20 μm from a coarse preliminary dispersion of 1 to 60% by volume of solids and at least 40 to 99% by volume of a non-solvent for the solid, having an average particle size <1 mm, said dispersion optionally including 1 to 100 parts by weight, with respect of the solids, of dispersing aids and/or surface-active compounds, consisting at least of a high pressure space (33) and a low pressure space (34) and a hole- or slit aperture-type nozzle (32) disposed therebetween, wherein the bore diameter or the aperture width of the nozzle (32) is from 0.05 to 1 mm and the length to diameter ratio of the bore in the nozzle (32) or the depth to aperture width ratio of the slit aperture of the nozzle is from 1:1 to 10:1 whereby, in operation, said coarse preliminary dispersion is passed through said apparatus, in at least one pass, while maintaining a pressure difference of at least 5 bar between the nozzle inlet and the nozzle outlet.

9. An apparatus for producing finely divided dispersions of solids having an average particle size of 0.01 to 20 μm, consisting of at least a high pressure space (33) and a low pressure space (34) and a comminution nozzle having at least two opposite bores (42, 42'), or nozzles (52, 52'), or apertures, disposed therebetween, said at least two opposite bores, nozzles or apertures having outlets which are spaced apart from each other a distance which is 2 to 50 times the diameter of the bores or nozzles or 2 to 50 times the aperture width, respectively; the diameters of the bores or nozzles or the width of the apertures being from 0.05 to 1 mm and the length to diameter ratio of the bores or nozzles or the depth to aperture width ratio of the aperture being from 1:1 to 10:1.

10. An apparatus according to claim 9, characterised in that the bore diameter or the aperture width of the aperture is from 0.1 to 5 mm.

11. The apparatus of claim 9 wherein said comminution nozzle is constructed of or coated with a ceramic material.

* * * * *